US009854928B1

(12) United States Patent
Clements

(10) Patent No.: US 9,854,928 B1
(45) Date of Patent: Jan. 2, 2018

(54) METHOD OF MANUFACTURING A SLEEVE FOR A BEVERAGE CONTAINER

(71) Applicant: Warren Scott Clements, Wyckoff, NJ (US)

(72) Inventor: Warren Scott Clements, Wyckoff, NJ (US)

( * ) Notice: Subject to any disclaimer, the term of this patent is extended or adjusted under 35 U.S.C. 154(b) by 303 days.

(21) Appl. No.: 14/687,168

(22) Filed: Apr. 15, 2015

Related U.S. Application Data

(62) Division of application No. 13/767,558, filed on Feb. 14, 2013, now abandoned.

(60) Provisional application No. 61/598,560, filed on Feb. 14, 2012.

(51) Int. Cl.

| | |
|---|---|
| ***B65D 81/38*** | (2006.01) |
| ***A47G 23/02*** | (2006.01) |
| ***B65D 23/08*** | (2006.01) |
| ***D05B 13/00*** | (2006.01) |

(52) U.S. Cl.
CPC ..... *A47G 23/0241* (2013.01); *B65D 23/08* (2013.01); *D05B 13/00* (2013.01)

(58) Field of Classification Search
CPC ..... A47G 23/0241; A47G 23/0266; A47G 23/0275; A47G 23/03; D05B 13/00; B65D 23/08; B65D 81/3876; A45F 3/16
See application file for complete search history.

(56) References Cited

U.S. PATENT DOCUMENTS

| | | | | |
|---|---|---|---|---|
| D541,596 | S * | 5/2007 | Hicks | D7/607 |
| 2007/0017924 | A1* | 1/2007 | Hundley | B65D 81/3876 220/737 |
| 2007/0145108 | A1* | 6/2007 | Dexel | B65D 81/3876 229/403 |
| 2012/0145731 | A1* | 6/2012 | Lee | B65D 81/3876 220/737 |

* cited by examiner

*Primary Examiner* — Jun Yoo
(74) *Attorney, Agent, or Firm* — Lawrence G. Fridman, Esq.; Feigin & Fridman, LLC

(57) ABSTRACT

A resilient sleeve for a beverage container is made from a continuous web of a fabric extending between distal and proximal ends thereof. A substantially linear base is provided at the proximal end. First and second sides extend outwardly from the opposite ends of the base. Two substantially symmetrical trapezoidal regions are formed at the distal end of the web, wherein each trapezoidal region is formed by an outer side positioned at a first predetermined angle to the first side and an inner side positioned at a second predetermined angle to a longitudinal axis of the web portion. A V-shaped cut out portion is formed at a central area of the web by the inner sides of the first and second trapezoidal regions. Width of the web portion corresponds to a circumference of the sleeve and length of the web portion corresponds to an axial length of the sleeve.

5 Claims, 2 Drawing Sheets

METHOD OF MANUFACTURING A SLEEVE FOR A BEVERAGE CONTAINER

CROSS REFERENCE TO RELATED APPLICATIONS

This Application is a Divisional of U.S. patent application Ser. No. 13/767,558 Filed: Feb. 14, 2013 currently pending, which Application claims priority to U.S. Provisional Patent Application No. 61/598,560 filed by Warren Scott Clements on Feb. 14, 2012 which Application is hereby incorporated in its entirety by reference.

FIELD OF THE INVENTION

The present invention relates to a sleeve or cover for containers or bottles used by consumers in their every day life, and more particularly it relates to a resilient, light-weight sleeve or jacket which is adapted to accommodate a variety of shapes and constructions of beverage containers or bottles.

BACKGROUND OF THE INVENTION

For many modern consumers, a personal beverage has become an important life-style accessory, similar to a PC, cell phone, key chain, or hand bag. As such, many consumers desire to differentiate or personalize their beverage container by a special sleeve or jacket that offers a unique characteristic to their own beverage item. In addition, consumers often confuse their own bottled beverage with those of their friends or colleagues, when these bottles are placed in close proximity of each other.

Further more, consumers often use a personal-size beverage (bottled water, soda, juice, sports drink, etc.) which typically have not been provided with personalized look or characteristic other than the manufacturers product label. Therefore, it is often difficult to differentiate or distinguish the same brand of bottled beverage from the next.

While a variety of enclosures or covers for beverage containers are presently commercially available, these covers typically do not offer the above-discussed highly desired functions to consumers. Therefore, there is a need to provide a unique sleeve/jacket for a beverage container which serves as a container identifier, so as to differentiate person's own bottled beverage from that of another, while simultaneously providing insulative and moisture absorbing functions. There is a further need for a single sleeve offering a universal fit to accommodate a wide range of sizes and shapes of beverage containers.

SUMMARY OF THE INVENTION

A sleeve for a beverage container of the invention relates to a product that is used to cover consumer beverage containers and bottles and, more specifically, used as a unique identifier to differentiate a bottle of a specific consumer from similar bottles. The sleeve of the invention offers a selection of unique graphic designs and is engineered to fit a variety of bottle shapes.

The sleeve for a beverage container serves as an insulation layer which keeps the bottled fluid cooler and provides a moisture barrier which keeps the hands of a consumer free from wetness. The 4-way stretch fabric characteristics offer a compression fit which enables the sleeve to expand and to accommodate beverage containers of various configurations.

A substantial outer surface of the sleeve is available for catchy slogans or advertising and unique designs. The sleeve remains durable, nice looking and maintains a tight, stretch fit for enumerable uses. The sleeve is manufactured to provide an appropriate fit, is non-bulky and comfortable to hold. Yet, the jacket/sleeve is easily placed on a container and taken off thereafter. Since the present jacket/sleeve is soft and foldable, it is portable for use repeatedly practically in any environment.

DETAILED DESCRIPTION OF THE INVENTION

Figure 1:
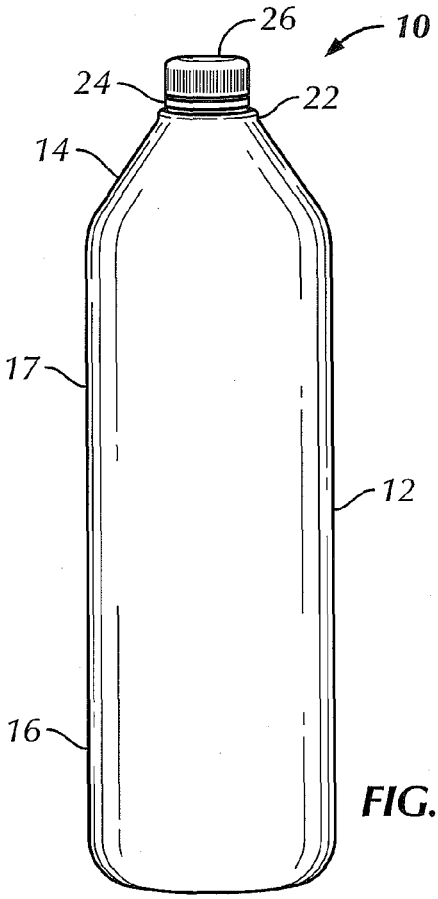
FIG. 1 is a front elevational view showing the sleeve of the invention being positioned on a beverage bottle or container.
Figure 3:
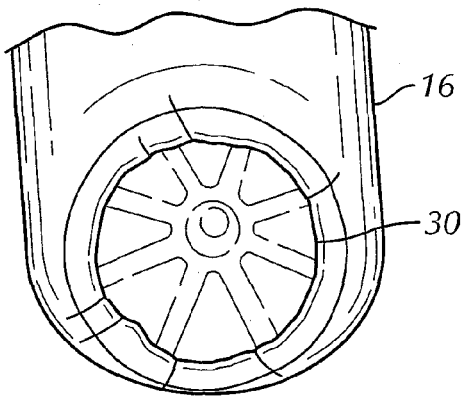
FIG. 3 is an enlarged, partial view showing the sleeve supporting a bottom portion of the container.
Figure 2:
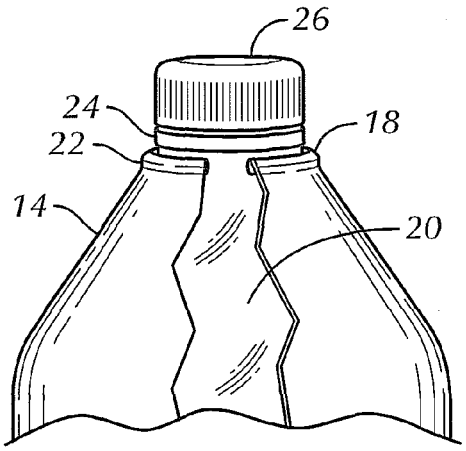
FIG. 2 is an enlarged partial view showing a top portion of the sleeve positioned on the container.

Referring now to the drawings wherein like reference numerals designate identical or corresponding parts throughout the several views, and more particularly to FIGS. 1-5, wherein a sleeve in accordance with the present invention is designated generally as 10. The sleeve 10 is illustrated in conjunction with a representative beverage container 20.

As best shown in FIGS. 1-5, the container sleeve 10 of the invention includes a body 12 which has a generally continuous sleeve construction extending between a top potion 14 and a base 16. A top opening 18 provided at the top portion 14 is expandable, so that a container 20 can be placed into the inner space of the sleeve 10. After the container 20 is placed therein, a neck element 22 surrounds a neck 24 of the container 20 allowing a dispensing top 26 of the container 20 to extend through the top of the sleeve. The body 12 generally conforms to the body of the container 20 when the container is inserted therein.

A resilient circumferential member or an elastic band 30 is incorporated into the base 16 of the sleeve. The resilient member 30 is placed circumferentially along the entire perimeter of the base. Proper positioning of the resilient member 30 is required since it provides additional compression around and under the base of a bottle or container positioned within the sleeve. Without the additional resiliency/elasticity provided by the resilient member 30 and the compression resulted therefrom, the weight of the beverage container or bottle (filled with a heavy liquid beverage) could cause the container to slide down through the base of the sleeve and out of the consumers hands.

There is another benefit deriving from positioning of the resilient member 30 at the base of the cover. Due to a condensation buildup, a wet ring is typically developed at the bottom of the bottle once it is placed on the supporting surface. In the invention the design of the base of the cover, including the resilient member catches the condensation. This prevents wet ring formation on the supporting surface, such as papers, table, etc.

While a specific container generally coinciding with the shape of the sleeve 10 is illustrated, other sizes and shapes of containers may be used in connection with the container jacket/sleeve 10. Moreover, the body 12 with the base 16 and/or opening 18 may be shaped differently than that depicted in FIGS. 1 and 2 in order to accommodate beverage containers having a different size and shape.

The sleeve 10 of the invention is preferably made from a resilient material 17 which is easy to clean, and is particularly appropriate for applying various design patterns and advertising messages. The material is absorbent for retaining moisture. Since the material 17 is resilient and deformable, it is appropriate to make the internal perimeter of sleeve 10 somewhat smaller than the circumference or outer periphery of container 20. In that fashion, as the container 20 is inserted into sleeve or jacket 10, the sleeve expands and deformed, so as to squeeze against the container exterior. In this facilitates retaining the sleeve 10 on the container 20.

More specifically, the sleeve for a beverage container of the invention is typically made from a stretchable, compression-fit fabric. This fabric serves as an insulation barrier which keeps the bottled fluid cooler, while blocking the body temperature transmitted from warm hands of a consumer. The fabric absorbs the moist condensation or "container sweat" which is formed on its walls and does not allow it to wick through the fabric, so as to keep the hands of the consumer dry.

Spandex is a lightweight, synthetic fiber that is often used to make stretchable clothing such as sportswear. It is made up of a long chain polymer called polyurethane, which is produced by reacting polyester with a discarnate. The polymer is converted into a fiber using a dry spinning technique.

Utilization of a lightweight synthetic fiber, such as Spandex, for example, in the fabric of the sleeve/jacket is essential to the invention for a number of reasons. This fabric can be stretched repeatedly, and will return back to original size and shape. This fabric is lightweight, soft and smooth and can be easily dyed. Inclusion of the Spandex-type fibers enhances stretchable characteristics as well as the ability of the fabric to recoil. This enables the cover/jacket of the invention to accommodate a variety of bottle shapes and diameters. Predetermined concentration/inclusion of Spandex-type lightweight synthetic fibers is essential. With insufficient concentration of the spandex-type fibers, the fabric and the sleeve will not expand enough. On the other hand, the excessive quantity of the Spandex-type fibers will be resulted in the sleeve/jacket becoming baggy. This prevents a tight fit engagement between the sleeve/jacket and the container.

A fabric having a unique blend of polyester and Spandex-type fibers assures a universal fit of the sleeve on a wide variety of beverage containers. A proper selection of fabric having a predetermined inclusion of the Spandex-type fibers is essential to the vertical and circumferential extension as well as compression of the final product. Although, use of a lightweight synthetic fiber such as polyurethane-polyurea copolymer (spandex) have been described with respect to the fabric of the sleeve of the invention, it should be understood that use of any type of synthetic fiber enhancing stretchable characteristics of the fabric is within the scope of the invention.

Typical beverage containers are available in a variety of shapes and sizes and can range from 16 oz. to 48 oz. in liquid capacity. Due to the elasticity and 4-way stretch composition of the utilized fabric, the sleeve/jacket of the invention is able to stretch and conform to the outer shape of the great variety of bottle configurations, while retaining its compression fit.

An essential aspect of manufacturing of the sleeve of the invention requires utilization of a unique pattern which is used as a template for cutting a material segment. In the method of the invention, a cutting step is followed by the sleeve assembly by means of sewing using the material segment. The pattern may be configured to the specific dimensions of the sleeve destined, or it may have standardized dimensions.

Figure 5:
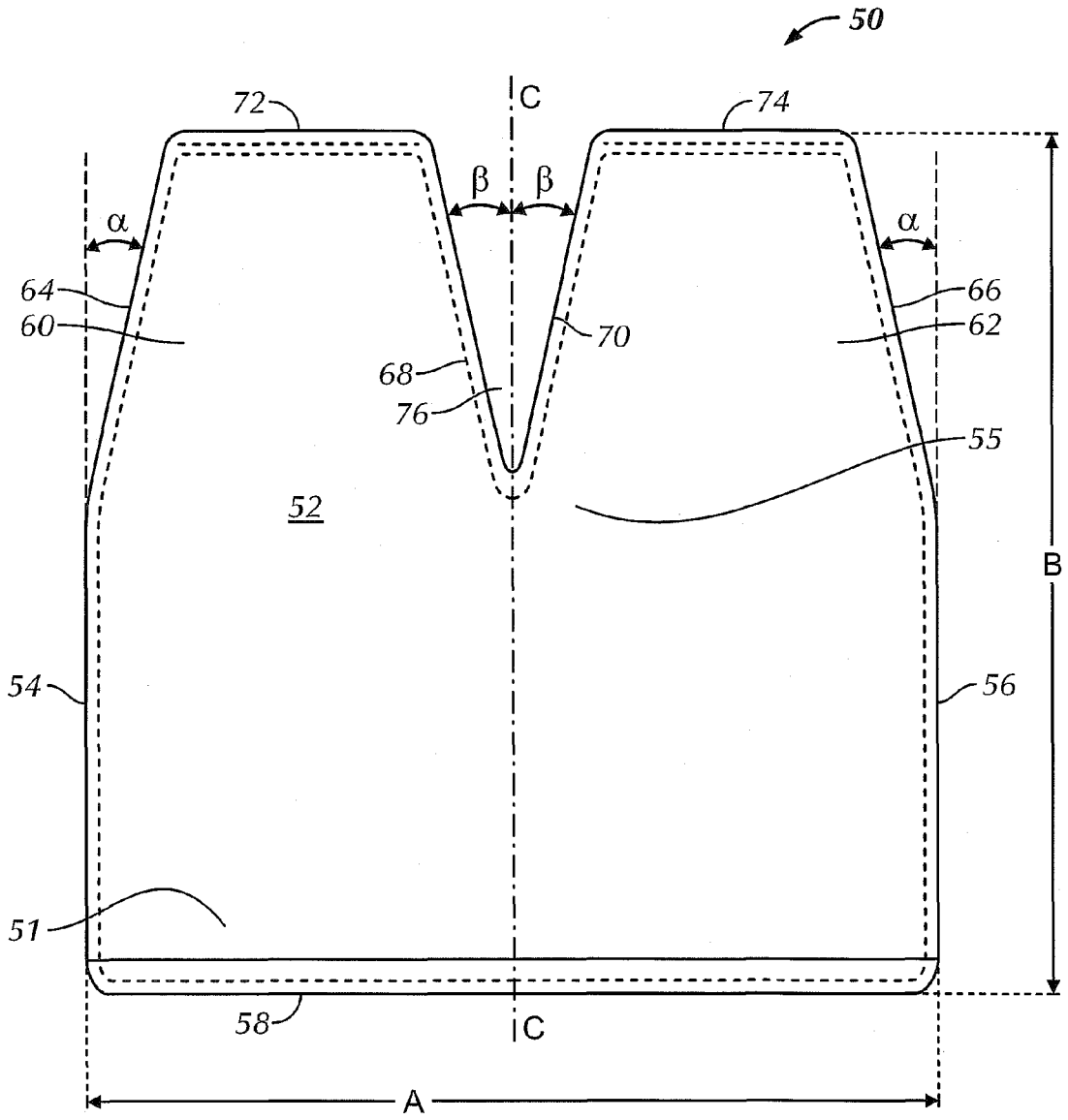
FIG. 5 is a plan view of a template and a material segment used in fabrication of the sleeve in accordance with the present invention.

As illustrated in FIG. 5, the template 50 is developed as a single continuous elongated rectangular portion 52, the width A of which corresponds to the circumference of the cover body of the cover/jacket, whereas the length B of which corresponds to the height, i.e. axial length/extension of the cover body 62.

As illustrated in FIG. 5, the template, template blank and corresponding fabric segment are formed by a linear base 58 provided at a proximal end 51 with sides 54 and 56 extending outwardly from the opposite end thereof. Two symmetrical trapezoidal regions 60 and 62 are formed at a distal end 55. The trapezoidal region 60 is formed by an outer side 64 which is positioned at a first angle £ to the side 54 and an inner side 68 positioned at a second angle β to a longitudinal axis C-C. In the preferred embodiment a top portion 72 is substantially parallel to the base 58. In a similar manner, the trapezoidal region 62 is formed by an outer side 66 extending at the angle £ to the side 56 and by the inner side 70 positioned at the angle β to the axis C-C. In this manner, a V-shaped cut out portion 76 is developed in the central area of the template blank. The first angle £ is typically within the range between 7 and 20°. However, in the preferred embodiment this angle is about 14°. Similarly, the second angle β is within the range between 7 and 20°. In the preferred embodiment this angle is about 14°. Thus, the inner sides 68 and 70 extend to each other forming a V-shaped cut out portion 76 with a central angle of about 28°.

Upon transferring the configuration of the template into the fabric, a material segment having configuration substantially identical to that of the template is being formed. For the purposes of simplicity, in our further discussion, the reference numerals and names of each element of the material segment used in the production of the sleeve will be identical to the corresponding elements of the above-discussed template/blank and template/blank. Through the use of the template the material segment is cut from a flattened web of the designated fabric into the shape depicted in FIG. 5.

According to the method of the invention, the sleeve is fabricated from the material segment 50 by folding it lengthwise along the axis C-C, so as to bring the opposing sides 54 and 56 into co-extensive juxtaposition. Simultaneously, the trapezoidal regions 60 and 62 are brought into face to face abutment. In this manner, the trapezoidal region 60 will face the trapezoidal region 62. The juxtaposed sides 54 and 56 and the outer sides 64 and 66 are then secured to one another. In a similar manner, the inner sides 68 and 70 are also secured to each other. According to the invention, essentially any conventional means of securement may be utilized, i.e., gluing, sewing or the alike. However, in the preferred embodiment the sleeve/jacket is fabricated from the material segment by utilizing a specific method of stitching which will be discussed in substantial detail hereinbelow.

Figure 4:
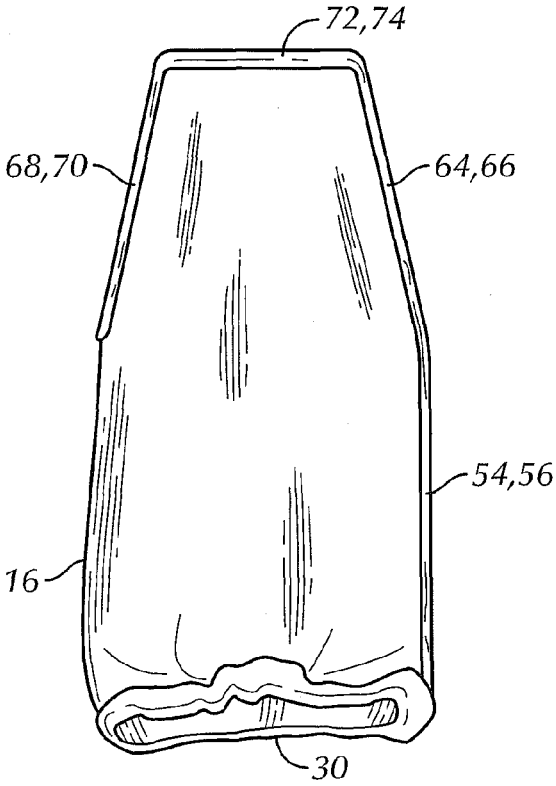
FIG. 4 is a view showing the sleeve of the invention being turned inside out.

In the preferred embodiment of the invention, as illustrated in FIG. 4 the sleeve 10 is then formed to orient the overlapping seams to face inwardly. As a result, a more pleasing outward appearance of the seams is created.

The method of manufacturing the sleeve for a beverage container of the invention consists of the following steps.

Step 1

Once the fabric 17 having a predetermined blend of Spandex-type fibers with polyester has been obtained, an initial step in forming the beverage container cover/jacket of the invention is to determine a correct layout of the fabric. It is known that four-way stretch fabrics have different stretch variations depending on the direction at which the fabric is stretched. According to the method, upon providing of a substantial rectangular fabric segment/panel, a person holds two opposite sides of the panel and pulls outwardly. The fabric will stretch a certain amount. When the other opposite sides of the fabric are pulled outwardly, the fabric will stretch a different amount. Determining the direction of the greater amount of stretch is essential to the initial layout of the fabric prior to cutting. The proper layout requires that the greater stretch direction of the fabric panel is oriented along the vertical/longitudinal axis of the sleeve/jacket to be produced. This orientation of the fabric panel allows the cover to be stretched, so as to accommodate a multiplicity of beverage containers having substantial variations in the vertical dimensions.

Step 2:

After the above-discussed proprietary pattern/template of the invention is being prepared, it should be transferred from a sheet member to a fabric panel/segment. In a mass production, the template/blank or a sheet member can be originally formed with the pattern embossed thereon, including the boundary lines, the joining seams, and the fold lines and reference lines. Once the pattern is prepared, it is then laid upon the fabric panel/segment, so as to be in contact therewith. Heat and/or pressure are then applied to release the features of the pattern from the sheet member to the fabric segment. In this step the fabric panel/segment is laid out, so as to have the greater stretch direction to be oriented vertically.

Step 3:

In the cutting step the fabric segment 50 is produced having configuration substantially identical to that of the template. As illustrated in FIG. 5, in the cut fabric segment sides 54 and 56 extend outwardly from the opposite sides of the linear base 58. Two symmetrical trapezoidal regions 60 and 62 are formed at the distal end 55 of the segment fabric. The trapezoidal region 60 is cut with an outer side 64 which is positioned at an angle £ to the side 54, and an inner side 68 positioned at an angle β to the longitudinal axis C-C of the segment. The top portion 72 is typically substantially parallel to the base 58. In a similar manner, the trapezoidal region 62 of the segment is cut and formed by an outer side 66 extending at an angle £ to the side 56 and by the inner side 70 positioned at an angle β to the axis C-C. During the cutting process a V-shaped cut out portion 76 is produced in the central area of the fabric segment. The angle £ is typically within the range between 7 and 20°. However, in the preferred embodiment this angle is about 14°. Similarly, the angle β is within the range between 7 and 20°. In the preferred embodiment this angle is about 14°. Thus, in the final version of the fabric segment the inner sides 68 and 70 are cut so as to extend to each other forming the V-shaped cut out portion 76 with a central angle of about 28°. This V-shaped design offers the identical angle cut on the opposite side of the fabric. Each cut is determined by the proprietary length and angle/degree of angle which has been designated by the bottle cover template. At this point all of the cuts have been substantially completed and the fabric panel/segment is ready to be assembled as a cover/jacket of the invention.

Step 4:

After the cutting step the material/fabric segment 50 is folded lengthwise along the axis C-C, so as to bring the opposing sides 54 and 56 into co-extensive juxtaposition. Simultaneously, the trapezoidal regions 60 and 62 are brought into face to face abutment. In this manner, the trapezoidal region 60 will face the trapezoidal region 62. The juxtaposed sides 54 and 56 and the outer sides 64 and 66 are then secured to one another. In a similar manner, the inner sides 68 and 70 are also secured to each other, see for example FIG. 4.

Step 5:

The next step in the method of manufacturing of the container sleeve is attaching or sewing together the open seems. In the preferred embodiment, the cover of the invention is sewn together when the fabric is oriented inside-out. This approach allows easy and efficient access to each seam.

The first seam to be sewn is the outer (long, open) edge. This seam is sewn from bottom to top. An overlocking serger stitch can be used in this step, so as to provide a clean tight seam or finish line of stitching. A serger stitch is a finish stitch used on the edge primarily because it offers flexibility, or the ability to expand and recoil as needed. The serger stitch typically consists of a series of looping diagonal stitches that allow for stretch in a variety of directions. This stitch is another key component in the creation of this bottle cover.

This serger stitch is essential to the fabrication of the cover/jacket of the invention because it allows for the seams to stretch along with the fabric. Other stitching does not stretch with the garment as easily and therefore could break when the bottle cover is being stretched repeatedly over different size bottles.

Step 6:

The next step of the method of the invention provides stitches across the base or bottom of the sleeve/jacket/cover. In order to accommodate flexibility over a variety of different bottle diameters, this seam also requires a base serger stitch, since it provides a great deal of stretchability for the product This seam in sewn in a circle to create an opening in order to allow for bottle(s) to fit up and inside the bottle cover. A unique aspect to this base seam is the addition to the resilient member itself. The resilient member 30 is incorporated into the base of the bottle cover, so that it is placed across the full length of the fabric at the base. Proper positioning of the resilient member 30 is essential since it provides additional compression around, and under the base of each bottle/container.

The base fabric is folded back, over the resilient member 30. This step is essential for a number of reasons. It holds the to the resilient member in place. Furthermore, the fabric at the base of the sleeve/cover is doubled creating the elastic band enclosure. Still further, this area absorbs the condensation that drips down on the walls of the respective container. A serger stitch, followed by a double finish stitch, is used to secure the fabric around the full circumference of the bottom, so as to secure the to the resilient member or elastic band into place.

Step 7:

In a further step of the method of the invention, the stitches at the V-shaped cut out portion/recess are provided at the center of the fabric panel. In the preferred embodiment, this seam is completed with the serger stitch, as it will undergo a good deal of repeated stretching.

Step 8:

The final stitch is performed at the neck element 22 of the bottle cover and this is actually a 2-step process. The material at the top of the bottle cover is first folded back over onto itself. This provides for a softer, more finished edge and it re-enforces this area of the bottle cover as it-too will be stretched to its limits. This seam is sewn in a circle to create an opening in order to allow for bottle spouts to fit up and inside the bottle cover, thus allowing consumers to drink from the bottle opening. The top of the neck is also folded over. This facilitates expansion and contraction of the sleeve/jacket and finishes the edge off and brings additional contraction to that neck or the circumference around the top of the container.

While the invention has been taught with specific reference to the above-described embodiments, those skilled in the art will recognize that changes can be made in form and detail without departing from the spirit and the scope of the invention. The scope of the invention is, therefore, indicated by the appended claims rather than by the foregoing description. All changes that come within the meaning and range of equivalency of the claims are to be embraced within their scope.

The invention claimed is:

1. A method of manufacturing a resilient sleeve for a beverage container, the method comprising of the steps of:

determining a correct layout of a fabric and positioning a fabric panel so that a greater stretch direction of the fabric panel is oriented along the longitudinal axis of the sleeve;

cutting a fabric segment from the fabric panel by utilizing a blank, so that the fabric segment is produced comprising, a continuous elongated web having the width corresponding to a circumference of the sleeve and the length corresponding to a height or axial length of the sleeve; a continuous elongated web portion extending between distal and proximal ends thereof, a substantially linear base provided at the proximal end, first and second sides extending outwardly from the opposite ends of the base; two substantially symmetrical trapezoidal regions are formed at the distal end of the web; each said trapezoidal region is formed by an outer side positioned at first predetermined angle to the first side and an inner side positioned at a second predetermined angle to a longitudinal axis of the web portion; a top portion of each said trapezoidal region is substantially parallel to the base; a V-shaped cut out portion is formed at a central area of the blank by the inner sides of the first and second trapezoidal regions developed in a central area of the fabric segment;

arranging the fabric segment prior to a step of assembly, by folding the fabric segment lengthwise along a longitudinal axis thereof, so as to bring the opposing first and second sides into co-extensive juxtaposition, and bringing the first and second trapezoidal regions into face to face abutment;

positioning the folded fabric segment to be in an inside-out orientation; and assembling the fabric segment by sewing together open seams.

2. A method according to claim 1, wherein the step of assembly further comprises:

providing stitches across a seam situated at the base of the sleeve, so that said base seam is sewn in a circle to form a base opening, wherein a circular resilient member is incorporated into the base of the sleeve in the vicinity of the base opening.

3. A method according to claim 1, wherein the step of assembly further compromises providing stitches at a periphery of the V-shaped cut out portion.

4. A method according to claim 1, wherein said continuous elongated web is formed having the width corresponding to a circumference of the sleeve and the length corresponding to axel extension of the sleeve.

5. A method according to claim 1, wherein the V-shaped cut out portion is formed having a central angle between the trapezoidal regions, said central angle is substantially equal to the sum of two said first predetermined angles.

* * * * *